United States Patent [19]

Bringhurst

[11] Patent Number: 4,833,980

[45] Date of Patent: May 30, 1989

[54] HIGH EFFICIENCY COIL POSTS FOR PRINT HAMMER ACTUATORS

[75] Inventor: Edward D. Bringhurst, Seattle, Wash.

[73] Assignee: Mannesmann Tally Corporation, Kent, Wash.

[21] Appl. No.: 91,126

[22] Filed: Aug. 31, 1987

[51] Int. Cl.[4] ..... B41J 3/10

[52] U.S. Cl. ..... 101/93.04; 101/93.48; 400/121; 400/157.2

[58] Field of Search ..... 400/124, 157.2, 157.3, 400/121; 101/93.04, 93.05, 93.48; 335/281; 336/211, 212, 233, 234

[56] References Cited

U.S. PATENT DOCUMENTS

| | | | |
|---|---|---|---|
| 393,337 | 11/1888 | Lane | 335/285 |
| 1,333,542 | 3/1920 | Geissinger | 335/281 X |
| 1,425,858 | 8/1922 | Hunt | 336/211 X |
| 1,457,619 | 6/1923 | Cohen | 336/211 X |
| 2,482,860 | 9/1949 | Miller | 335/281 X |
| 3,201,729 | 8/1965 | Blanchi | 335/281 X |
| 3,339,163 | 8/1967 | Wentz et al. | 336/210 |
| 3,497,845 | 2/1970 | Bernier | 335/234 |
| 3,497,949 | 3/1970 | Salt | 29/609 |
| 3,584,823 | 6/1971 | Andrew et al. | 248/314 |
| 3,609,615 | 9/1971 | Parker et al. | 336/178 |
| 3,725,832 | 4/1973 | Schweitzer, Jr. | 336/96 |
| 3,792,399 | 2/1974 | McLyman | 336/210 |
| 3,858,311 | 1/1975 | Klappert | 29/609 |
| 4,085,347 | 4/1978 | Lichius | 310/259 |
| 4,203,085 | 5/1980 | Elasser | 336/210 |
| 4,503,768 | 3/1985 | Whitaker | 101/93.04 |
| 4,552,475 | 11/1985 | Suzaki | 400/157.2 X |
| 4,584,937 | 4/1986 | Bringhurst | 101/93.04 |

FOREIGN PATENT DOCUMENTS

| | | | |
|---|---|---|---|
| 19543 | 1/1985 | Japan | 400/157.2 |
| 73856 | 4/1985 | Japan | 400/157.2 |

*Primary Examiner*—Paul T. Sewell

*Attorney, Agent, or Firm*—Christensen, O'Connor, Johnson & Kindness

[57] ABSTRACT

Stored energy print hammer actuators (11) having high efficiency coil posts (19) are disclosed. The coil posts (19) include a cylindrical core (33) mounted on a pin (35). The cylindrical core (33) has high resistivity and, thus, minimizes eddy currents and the power losses created by eddy currents. The cylindrical core (33) also has low hysteresis loss. In one form, the core (33) is formed of layers of a high resistivity material shaped to prevent eddy currents from circulating about the circumference of the posts. Suitable shapes include discrete C-layers and continuous spiral layers. Preferably, the layers are coated with an electrical insulating material that prevents cross-lamination eddy current flow. In another form, the core is formed of a high resistivity homogenous material, such as a ferrite material or a magnetic powder and an adhesive binder.

32 Claims, 1 Drawing Sheet

HIGH EFFICIENCY COIL POSTS FOR PRINT HAMMER ACTUATORS

TECHNICAL AREA

This invention relates to actuating mechanisms and, more particularly, actuating mechanisms for printers, specifically dot matrix printers.

BACKGROUND OF THE INVENTION

In general, dot matrix printers can be separated into two categories—dot matrix line printers and dot matrix serial printers. Both categories of printers create images (characters or designs) by selectively printing a series of dots in an X-Y matrix. Dot matrix serial printers include a print head that is moved horizontally back and forth across a sheet of paper, either continuously or in steps. The print head includes a vertical column of dot printing elements. As each column position of a character position is reached during printing, the required number of dot-printing elements are actuated to form dots. A series of thusly created vertical dot columns form the desired character. Contrariwise, dot matrix line printers include a dot-printing mechanism for creating horizontal lines and dots substantially simultaneously as paper is stepped through the printer. A series of horizontal lines of dots creates an image, i.e., a row of characters or a design. While the present invention may find use in other areas, because it was designed for use in dot matrix printers, it is described in connection with such a printer.

In the past, various types of actuating mechanisms for use in dot matrix printers have been proposed and implemented. Examples of actuating mechanisms for use in dot matrix line printers are described in U.S. Pat. No. 4,503,768, entitled "Single Piece Hammer Module" and U.S. Pat. No. 4,584,937, entitled "Long Release Coil Hammer Actuating Mechanism," both assigned to the assignee of the present application. Both of these patents describe actuating mechanisms incorporated in hammer modules that include a plurality of cantilever mounted print hammer arms formed of a resilient ferromagnetic material. Located on the end of each print hammer arm is an anvil (e.g., a ball) that prints a dot when the associated hammer arm is actuated. Each hammer actuation mechanism comprises a permanent magnet, a post and plates that create a magnetic path between the permanent magnet and the post, plus a release coil mounted on the post. In the absence of current through the release coil, the print hammer arm is attracted to the post by the magnetic field produced by the permanent magnet. The attraction stresses the hammer arm. The thusly cocked hammer arm is released by energizing a release coil such that the coil produces a magnetic field that counteracts the magnetic post attraction field created by the permanent magnet. When released, the stored energy resulting from stressing a resilient hammer arm causes the hammer to impact the anvil against the ribbon and create a dot on a print receiving medium.

While dot-printing mechanisms of the type generally described above have a number of advantages over previously developed dot-printing mechanisms for use in dot matrix line printers and, thus, form a significant step forward in this art, it has been found that such dot printing mechanisms can be improved. In this regard, in the past, the posts of dot matrix serial and line printer actuators of the type described above have been formed of wear resistant, magnetically permeable materials. While, from a wear point of view, such materials having long lifetimes, from a magnetic point of view they are undesirable because of their low resistivity. As a result of their low resistivity, when current is applied to the release coil to release a hammer to create a dot, the magnetization of the coil post changes. The magnetization change creates eddy currents, resulting in a loss of power. The eddy current power loss generates undesirable heat. In addition, since eddy currents produce an opposing magnetic field they slow down hammer release. In order to compensate for this slowing effect, coil drive current must be increased if the desired speed is to be maintained.

Other types of magnetic devices, such as transformers and motors have dramatically reduced eddy current power losses by the use of laminated cores formed of thin, flat sheets of a high resistivity magnetic material. Frequently, the chosen material also has low hysteresis loss. Unfortunately, high resistivity materials wear when subjected to mechanical forces. Thus, in the past, the need for wear resistance at the point where the hammer impacts the post, i.e., the post tip, has prevented the use of the magnetically most desirable post materials. This invention is designed to overcome this disadvantage by providing a coil post for a print actuator, in particular a dot matrix line or serial print actuator, that minimizes eddy currents and, thus, the power loss resulting from eddy currents, while satisfying the need for wear resistance at the point where the hammer impacts the post.

SUMMARY OF THE INVENTION

In accordance with this invention, a stored energy print hammer actuator having a high efficiency coil post is provided. The coil post includes a cylindrical core mounted on a pin. The cylindrical core has high resistivity and, thus, minimizes eddy currents and the power losses created by eddy currents.

In accordance with other aspects of the invention, the core is formed of layers of a high resistivity material shaped to prevent eddy currents from circulating about the circumference of the post. Suitable shapes include discrete C-shaped sleeves and continuous spiral layers. Preferably, the sleeves or layers are coated with an electrical insulating material that prevents cross-lamination eddy current flow.

In accordance with alternative aspects of this invention, the core is formed of a high resistivity homogenous material. The homogenous material may be a ferrite material or a magnetic powder and an adhesive binder, for examples.

As will be readily appreciated from the foregoing description, the combination of a high resistivity core and a pin allows the low resistivity disadvantages of prior coil posts to be overcome while retaining the high wear resistance advantages of such posts. The use of a high resistivity core reduces eddy currents and the power losses associated therewith while the inclusion of a pin allows the tip of the post to be wear resistant. If desired, the post material can also be chosen to have low hysteresis loss and, thereby, further reduced power loss. In addition, the reduction of eddy currents allows more rapid flux switching and, hence, a faster print speed. Cores formed of one or more C-shaped layers of high resistivity are particularly advantageous in reducing eddy currents. More specifically, primary eddy currents flow circumferentially in coil posts. Since slots or gaps in C-shaped layers prevent circumferential current flow, such slots or gaps prevent primary eddy current flow. Secondary eddy currents flow in small loops in C-shaped layers. The choice of a high resistivity material reduces small loop, i.e., secondary, eddy current flow.

BRIEF DESCRIPTION OF THE DRAWINGS

The foregoing and other features and advantages of the present invention will become better understood from the following detailed description when taken in conjunction with the accompanying drawings, wherein.

DESCRIPTION OF THE PREFERRED EMBODIMENTS

Figure 1:
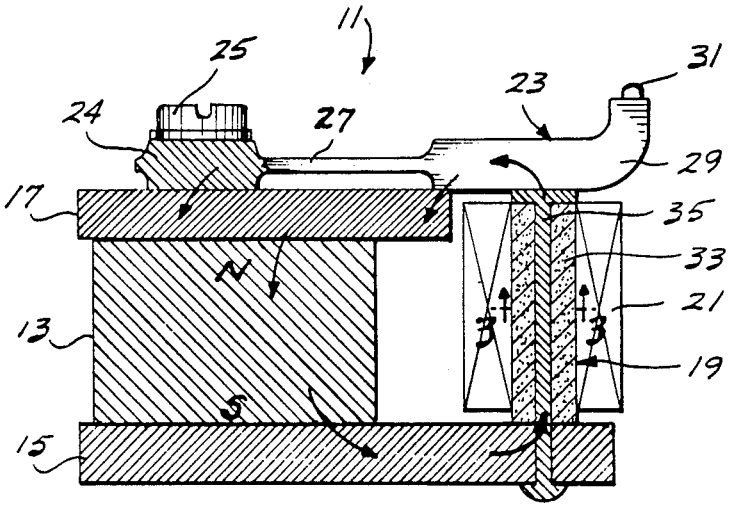
FIG. 1 is a cross-sectional view illustrating a dot matrix print hammer actuator formed in accordance with the invention.

FIG. 1 is a cross-sectional view of a hammer actuating mechanism 11 including a coil post formed in accordance with the invention. The hammer actuating mechanism 11 illustrated in FIG. 1 comprises: a permanent magnet 13; a flux plate 15; a return plate 17; a post 19; a release coil 21; and, a hammer 23. The flux and return plates 15 and 17 are mounted on the oppositely polarized faces of the permanent magnet 13 and extend outwardly therefrom in the same direction. The flux plate 15 extends outwardly a substantially greater distance than the return plate 17. The post 19 is mounted near the outer end of the flux plate 15 on the surface that faces the return plate 17. The tip of the post 19 terminates in a plane lying substantially coplanar with the outer surface of the return plate 17. The release coil 21 is mounted on the post 19. The release coil 21 extends outwardly, terminating just short of the tip of the post 19.

The hammer 23 is cantilever mounted. More specifically, the hammer 23 is attached to the outer face of the return plate 17, in the region 24 where the return plate 17 overlies the permanent magnet 13, by cap screw 25. The hammer 23 includes a thin region 27 extending outwardly from the attachment region 24 toward the post 19. Located at the other end of the hammer 23 is a head 29. The head overlies the gap between the tip of the post 19 and the adjacent end of the return plate 17. Further, the head 29 curves outwardly and terminates in a flat region to which is welded a print ball 31.

The permanent magnet 13 of the hammer actuating mechanism 11 illustrated in FIG. 1 pulls the head 29 against the tip of the post 19 and the end of the return plate 17, whereby the head provides a bridge between these elements. Preferably, the head is pulled tightly against the tip of the post 19 and a small gap (0.001–0.005 inches) is present between the head and the end of the return plate. In the absence of the magnetic field produced by the permanent magnet 13, the head 29 would separate from the tip of the post 19 and the outer end of the return plate 17 by a very small amount, preferably lying in the 16–20 thousandths of an inch range. When the permanent magnet 13 pulls the head 29 across the gap, against the tip of the coil post 19 and the outer end of the return plate 17, the thin region 27 of the hammer 23 is stressed and, thus, the hammer 23 is cocked.

When the coil 21 is energized in the appropriate direction, it produces a magnetic field that counteracts the magnetic field created by the permanent magnet 13. As a result, the hammer 23 is released. Release of the hammer 23 results in the energy stored in the thin region 27 moving the head 29 of the hammer 23 and, thus, the ball 31 away from the coil post tip and creating a dot on a print receiving medium in a conventional manner.

Figure 2:
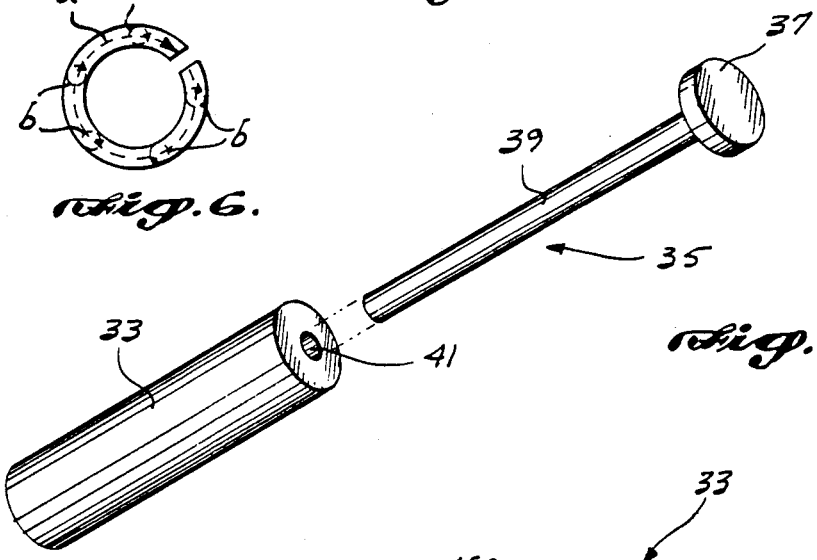
FIG. 2 is an enlarged exploded view of the coil post of the dot matrix print hammer actuator illustrated in FIG. 1.

Rather than the coil post 19 being formed of a solid, wear resistant, low resistivity magnetically permeable material as in previous print hammer actuators of the type illustrated in FIG. 1, in accordance with this invention, the coil post 19 of the print hammer actuator illustrated in FIG. 1 is formed of two components—a cylindrical core 33 and a pin 35. As best illustrated in FIG. 2, the pin 35 includes a large, flat head 37 and a cylindrical shaft 39. The cylindrical core 33 includes a longitudinal cylindrical hole 41 sized to receive the shaft 39 of the pin 35. The shaft 39 of the pin 35 is slightly longer than the length of the cylindrical core 33. The projecting portion of the shaft 39 is mounted in a hole in the flux plate 15 and peened on the remote side of the flux plate 15 to rigidly attach the post 19 to the flux plate 15.

The pin 35 is formed of a hard wear resistant, magnetically permeable material. Materials previously used to form solid posts can be used to form the pin, for example.

Figure 3:
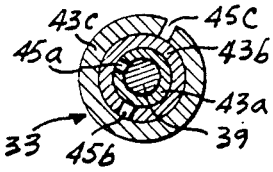
FIGS. 3–5 are cross-sectional views taken along line 3—3 of FIG. 1 illustrating various embodiments of coil posts formed in accordance with the invention; and, FIG. 6 is an enlarged cross-sectional view of one of the C-shaped sleeves of the coil post illustrated in FIG. 3.
Figure 4:
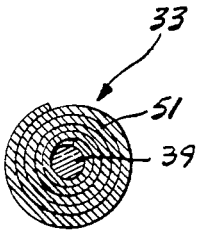
Figure 5:
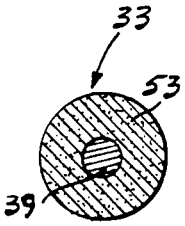

As illustrated in FIGS. 3, 4 and 5, the cylindrical core 33 may be layered or homogenous. In either case the core resistivity is high, preferably above 40 microhm-cm. More specifically, FIG. 3 illustrates a cylindrical core 33 formed of a plurality of concentric, cylindrical sleeves **43*a*, 43*b* and 43*c*. Each of the cylindrical sleeves 43*a*, 43*b* and 43*c* includes a gap 45*a*, 45*b* and 45*c*. Thus, each of the sleeves is C-shaped. The sleeves are sized such that the inner diameter of one sleeve is the same as the outer diameter of the next inner sleeve. The inner diameter of the innermost sleeve 43*a* is the same as the diameter of the shaft 39 of the pin 35. When mounted on the shaft 39, the gaps 45*a*, 45*b* and 45*c* may be aligned or nonaligned. In essence, the cylindrical core 33 illustrated in FIG. 3** is a layered core wherein each layer is C-shaped. The layers are formed of a high resistivity material, such as silicon steel. Preferably, the chosen material also has low hysteresis loss, e.g., a hysteresis loss below 0.018 watts/sec/cycle/lb. Also, preferably, the layers are coated with an electrical insulating material, such as phosphate or AISI-C5, to prevent cross-lamination eddy current flow.

Figure 6:
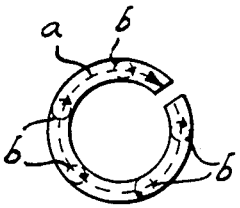

FIG. 6 is an enlarged, cross-sectional view of one of the sleeves of the coil post illustrated in FIG. 3 illustrating the flow of eddy currents. As shown by dashed line "a" primary eddy currents normally flow circumferentially in a coil post. Such current flow is prevented by the gaps or slots in the C-shaped sleeves. As shown by dashed lines "b" secondary eddy currents flow in small loops in the C-shaped sleeves. The high resistivity of the C-shaped sleeve material reduces secondary eddy current flow.

FIG. 4 illustrates an alternative embodiment of a layered cylindrical core 33 formed in accordance with the invention. More specifically, FIG. 4 illustrates a spiral 51 formed of a high resistivity material having a center hole suitable for receiving the shaft 39 of the pin 35. In essence, the outer diameter of the spiral 51 is equal to the diameter of the head 37 of pin 35. The spiral 51 is formed of a high resistivity material, such as silicon steel. Like the layered embodiment of the invention illustrated in FIG. 3, preferably, the surface of the material is coated with an electrical insulating material to prevent cross-lamination eddy current flow.

In addition to forming the cylindrical core 33 of layers of high resistivity material, as illustrated in FIG. 5, the cylindrical core can be formed of a homogenous material 53. The homogenous material 53 may be a sintered ferrite material or a magnetic powder and an adhesive binder, for examples.

As will be readily appreciated from the foregoing description, the invention provides an improved efficiency cylindrical coil post suitable for use in a print hammer actuator, in particular, a dot matrix line or serial print hammer actuator. The high resistivity material used to form the cylindrical corel reduces eddy currents and, thus, the power loss created by eddy current fields. The reduction in eddy current flow also improves print hammer movement and, thus, printing speed. While the illustrated multiple split sleeve configuration (FIG. 3) includes three C-shaped layers, it is to be understood that one, two or more than three concentric layers can be used if desired. Like with the spiral layer embodiment (FIG. 4), the use of thinner material and more layers leads to greater efficiency. The homogenous (i.e., the powdered composite or ferrite) post embodiments of the invention (FIG. 5) essentially eliminate eddy currents by virtue of very high electrical resistivity. As is well known to those skilled in the art, ferrite can essentially be an electrical insulator. A powdered composite is a mixture of magnetic powder and an adhesive binder. High electrical resistivity is a result of the inclusion of the binder, which separates the magnetic power. One disadvantage of the use of ferrite and magnetic powder insulators is that their flux carrying capacity is generally lower than the flux carrying capacity of magnetic steels. On the other hand, like the layered embodiments of the invention, homogenous material embodiments of the invention reduce eddy currents, which reduce power loss, while allowing faster flux switching. In this regard, it should be noted that the production of eddy currents, which produce a magnetic field that opposes the driving field, in essence, increases switching time.

In accordance with the invention, as noted above, the pin is formed of a hardened or hardenable material that has magnetic properties. Because hardenable materials generally have poorer magnetic properties than soft materials, it is desirable that the size of the pin be minimized to the extent allowed by structural and other requirements.

While preferred embodiments of the invention have been illustrated and described, it will be appreciated that various changes can be made therein without departing from the spirit and scope of the invention. For example, an improved efficiency cylindrical coil post formed in accordance with the invention can be used in magnetic actuators other than the type illustrated in FIG. 1. Futher, rather than being round, the cross-sectional configuration of the coil posts can take on other shapes—square or hexagonal, for examples. Hence, the invention can be practiced otherwise than as specifically described herein.

The embodiments of the invention in which an exclusive property or privilege is claimed are defined as follows:

1. A print hammer mechanism for a dot matrix printer comprising:

a permanent magnet transversely polarized such that said permanent magnet has a pair of opposed polarized faces lying parallel to one another;

a flux plate formed of a magnetically permeable material having a base and an arm, said base mounted on one of said polarized faces of said permanent magnet such that said arm extends outwardly in the plane defined by said one of said polarized faces;

a coil post mountaed on the end of said arm of said flux plate so as to overlie said permanent magnet, said coil post comprising a pin formed of a magnetically permeable material and a high resistivity core mounted on said pin, said pin including a shaft and a large flat head located on one end of said shaft, the end of said shaft opposite said large flat head being attached to said flux plate, said large flat head being wear resistant;

a coil mounted on said coil post;

a return plate formed of a magnetically permeable material having a base and an arm, said base mounted on said other of said polarized faces of said permanent magnet such that said arm extends outwardly in the plane of said other of said polarized faces towards said coil post, the length of said coil post being such that the tip of said coil post lies substantially coplanar with the face of said return plate facing away from said permanent magnet;

a print hammer formed from a piece of magnetically permeable material, said print hammer having a base and an arm, said base attached to said base of said return plate such that said arm of said print hammer overlies said arm of said return plate and the tip of said coil post; and, a dot print element attached to one end of said print hammer on the side of said print hammer remote from said outer end of said arm of said return plate and the tip of said post.

2. A print hammer mechanism as claimed in claim 1, wherein said high resistivity core is formed of layers of high resistivity material.

3. A print hammer mechanism as claimed in claim 2, wherein said layers are coated with an electrical insulating material.

4. A print hammer mechanism as claimed in claim 3, wherein said high resistivity core layers are formed of a material having low hysteresis loss.

5. A print hammer mechanism as claimed in claim 2, wherein said high resistivity core layers are formed of a material having low hysteresis loss.

6. A print hammer mechanism as claimed in claim 2, wherein said layers are concentric C-shaped layers having gaps.

7. A print hammer mechanism as claimed in claim 6, wherein said layers are coated with an electrical insulating material.

8. A print hammer mechanism as claimed in claim 7, wherein said high resistivity core layers are formed of a material having low hysteresis loss.

9. A print hammer mechanism as claimed in claim 6, wherein said high resistivity core layers are formed of a material having low hysteresis loss.

10. A print hammer mechanism as claimed in claim 2, wherein said layers define a spiral wound about said pin.

11. A print hammer mechanism as claimed in claim 10, wherein said layers are coated with an electrical insulating material.

12. A print hammer mechanism as claimed in claim 11, wherein said high resistivity core layers are formed of a material having low hysteresis loss.

13. A print hammer mechanism as claimed in claim 10, wherein said high resistivity core layers are formed of a material having low hysteresis loss.

14. A print hammer mechanism as claimed in claim 1, wherein said high resistivity core is formed of a homogenous material.

15. A print hammer mechanism as claimed in claim 14, wherein said homogenous material is a sintered ferrite material.

16. A print hammer mechanism as claimed in claim 14, wherein said homogenous material includes a magnetic powder and an adhesive binder.

17. A print hammer actuator wherein a print hammer formed of a resilient, elongate piece of magnetically permeable material is pulled against a coil post mounted on a flux plate and released to create a print force, the improvement coprising:

a coil post formed of a pin of magnetically permeable material and a high resistivity core mounted on said pin, said pin comprising a shaft and a large flat head located on one end of said shaft, the end of said shaft opposite said large flat head being attached to said flux plate, said large flat head of said pin facing said print hammer and, thus, being the end of said pin toward which said hammer is drawn, said large flat head being wear resistant.

18. The improvement claimed in claim 17, wherein said high resistivity core is formed of layers of high resistivity material.

19. The improvement claimed in claim 18, wherein said layers are coated with an electrical insulating material.

20. The improvement claimed in claim 19, wherein said high resistivity core layers are formed of a material having low hysteresis loss.

21. The improvement claimed in claim 18, wherein said high resistivity core layers are formed of a material having low hysteresis loss.

22. The improvement claimed in claim 18, wherein said layers are concentric C-shaped layers having gaps.

23. The improvement claimed in claim 22, wherein said layers are coated with an electrical insulating material.

24. The improvement claimed in claim 23, wherein said high resistivity core layers are formed of a material having low hysteresis loss.

25. The improvement claimed in claim 22, wherein said high resistivity core layers are formed of a material having low hysteresis loss.

26. The improvement claimed in claim 18, wherein said layers define a spiral wound about said pin.

27. The improvement claimed in claim 26, wherein said layers are coated with an electrical insulating material.

28. The improvement claimed in claim 27, wherein said high resistivity core layers are formed of a material having low hysteresis loss.

29. The improvement claimed in claim 26, wherein said high resistivity core layers are formed of a material having low hysteresis loss.

30. The improvement claimed in claim 17, wherein said high resistivity core is formed of a homogenous material.

31. A print hammer mechanism as claimed in claim 30, wherein said homogenous material is a sintered ferrite material.

32. A print hammer mechanism as claimed in claim 30, wherein said homogenous material includes a magnetic powder and an adhesive binder.

* * * * *